United States Patent [19]

Mosemiller

[11] 4,006,685

[45] Feb. 8, 1977

[54] AXIAL AND CIRCUMFERENTIAL REGISTER CONTROL APPARATUS FOR A CYLINDER IN A PRESS FRAME

[75] Inventor: Robert L. Mosemiller, Pittsburgh, Pa.

[73] Assignee: Miller Printing Machinery Co., Pittsburgh, Pa.

[22] Filed: Sept. 22, 1975

[21] Appl. No.: 615,596

[52] U.S. Cl. ..... 101/248; 74/395; 74/675

[51] Int. Cl.[2] ..... B41F 13/24

[58] Field of Search ..... 101/248, 247, 169; 74/640, 675, 395, 396

[56] References Cited

UNITED STATES PATENTS

| | | | |
|---|---|---|---|
| 2,181,894 | 12/1939 | Huck | 101/248 |
| 2,181,895 | 12/1939 | Huck | 101/248 |
| 2,666,385 | 1/1954 | Bender | 101/248 |
| 2,775,935 | 1/1957 | Reinartz et al. | 101/248 |
| 2,948,216 | 8/1960 | Thompson | 101/248 |
| 2,989,918 | 6/1961 | Polglase, Jr. | 101/248 |
| 3,565,006 | 2/1971 | Stewart | 101/248 |
| 3,750,568 | 8/1973 | Weisgerber | 74/395 X |
| 3,817,176 | 6/1974 | Schultz | 74/675 X |
| 3,896,724 | 7/1975 | Muselik | 101/248 |

FOREIGN PATENTS OR APPLICATIONS

| | | | |
|---|---|---|---|
| 1,385,941 | 3/1975 | United Kingdom | 101/248 |

*Primary Examiner*—E. H. Eickhold
*Attorney, Agent, or Firm*—Stanley J. Price, Jr.; John M. Adams

[57] ABSTRACT

A plate cylinder has a shaft end portion that is rotatably supported in a press frame for axial movement relative thereto. A gear hub is axially movable and coaxially positioned on the shaft end portion. A helical driven gear is coaxially positioned on and non-rotatably secured to the gear hub. The teeth of the driven gear mesh with the helical gear teeth of a drive gear fixed relative to the driven gear. A circumferential adjustment housing is rotatably secured to the gear hub to permit rotation of the gear hub relative to the housing. The housing is non-rotatably positioned for axial movement in a support frame that extends outwardly from the press frame. Resilient members retained within the circumferential adjustment housing urge the housing to move axially relative to the support frame. A circumferential adjustment mechanism is non-rotatably secured to the circumferential adjustment housing and axially moves the housing toward and away from the main frame. The gear hub and the driven gear move axially with the housing relative to the drive gear to rotate the driven gear and the shaft end portion to adjust the circumferential register of the plate cylinder while the cylinder is rotating or is stationary. An axial adjustment housing is secured to the shaft end portion to permit rotation thereof relative to the housing. The axial adjustment housing is urged toward and away from the press frame relative to the circumferential adjustment housing by resilient members that are retained within the housing. The axial adjustment housing is threadedly secured to an axial adjustment mechanism that advances the housing toward and away from the press frame by the resilient members to axially move the plate cylinder shaft end portion relative to the press frame and thereby adjust the axial register of the plate cylinder while the cylinder is rotating or is stationary.

19 Claims, 5 Drawing Figures

10
12
14
16
18
20
22
24
26
27
28
29
30
32
34
36
38
40
42
46
48
50
51
52
54
56
57
58
60
62
64
66
68
72
81
82
84
86
88
90
92
93
96
98
100
104
106
108
110
112
114
116
117
118
120
122
130
132
134
136
137
138
139
140
141
142
144
146
148
II
III

AXIAL AND CIRCUMFERENTIAL REGISTER CONTROL APPARATUS FOR A CYLINDER IN A PRESS FRAME

BACKGROUND OF THE INVENTION

1. Field of the Invention

This invention relates to apparatus for adjusting the position of a cylinder in a press frame and more particularly to control apparatus for adjusting the axial and circumferential register of a plate cylinder in a press frame.

2. Description of the Prior Art

In the field of rotary printing presses control mechanisms are utilized to maintain the correct axial and circumferential register of the plate cylinder in relation to the press frame of the machine while the plate cylinder is rotating. The need to maintain accurate control of the circumferential and axial register of the plate cylinder is particularly important when a plurality of colors are used to print items. It is particularly important that in the case of misalignment the proper register may be provided by axially and/or circumferentially adjusting the position of the plate cylinder in the press frame during operation. A register control device that requires adjustment of both circumferential and axial register only while the printing machine is stopped is time consuming and after each adjustment it is not possible to determine whether the adjustment is correct. Therefore, register control mechanisms that permit independent adjustment to the circumferential and axial register of the plate cylinder while the cylinder is rotating have been suggested.

U.S. Pat. No. 3,308,752 discloses operating means for adjusting from the operating side when the machine is in motion the plate cylinder circumferentially in relation to its drive and independently move the plate cylinder along its rotational axis in relation to the frame in the machine. The axial adjustment of the plate cylinder is provided by a rotary operating member that is threaded to an axially movable non-rotatable member which is connected to the mechanism for producing the relative angular movement. The rotary operating member has gear teeth that are engaged by a gear that is rotated by operation of a hand wheel to provide the desired axial displacement. Accordingly, the angular or circumferential movement of the plate cylinder is provided by a crank shaft that is mounted for rotation to the relatively movable parts of the cylinder. The crank shaft is pivotally connected at one end to an axially movable element and at the other end to the other relatively movable part so that relative angular movement between the parts results when the axially movable element is moved and the crank shaft rotates.

In U.S. Pat. No. 3,817,176 there is disclosed a register control unit which permits the advancing or retarding of the printing cylinder independent of the line drive during operation. The independent motor means and gearing connect the register control unit with the impression cylinder, and actuation of the register control unit motor advances or retards the impression cylinder to provide the correct register during operation of the machinery.

U.S. Pat. No. 3,565,006 discloses a motor driven harmonic gear drive for changing the angular phase relationship of the driving gear and the printing gear. German Pat. No. 1,032,755 discloses apparatus for adjusting the axial and circumferential register of a plate cylinder during the printing operation. The circumferential adjustment is accomplished by the axial shafting of the helical drive gear on the plate cylinder. The axial register adjustment is provided by the axial shifting of the plate cylinder while the drive gear opposite the machine frame remains axially fixed. German Pat. No. 1,077,231 discloses apparatus for adjusting the circumferential register by means of a lever type pivoting device.

There is need to provide apparatus for adjusting the circumferential and axial register of a plate cylinder in a press frame during operation of the press having a minimum number of adjusting gears and connections to provide precise circumferential and axial register adjustment. The register control apparatus should permit the independent and simultaneous adjustment of the circumferential and axial register while the plate cylinder is rotating.

SUMMARY OF THE INVENTION

In accordance with the present invention, there is provided apparatus for adjusting the axial and circumferential position of a cylinder in a press frame that includes a cylinder having a shaft end portion. A frame member rotatably supports the shaft end portion, and the cylinder is mounted for axial movement relative to the frame member. A housing is rotatably secured to the shaft end portion for axial movement relative to the frame member. The shaft is provided with a threaded end portion. A support frame positioned adjacent the frame member is secured to and extends outwardly therefrom for non-rotatably supporting the housing. The adjacent supporting frame is non-rotatably fixed to the frame member. The housing is arranged for axial movement relative to the adjacent support frame. Resilient devices are retained within the housing with one end portion abutting the housing and the other end portion immovably fixed by the adjacent support frame. The resilient members are operable to axially move the housing in a preselected direction relative to the adjacent support frame. An axial adjustment mechanism is secured to the housing threaded end portion and is rotatably fixed to the adjacent support frame. The axial adjustment mechanism is operable to axially move the housing in a preselected direction relative to the frame member. Movement of the axial adjustment mechanism in one direction axially moves the housing in a corresponding direction to urge the resilient members to exert a force upon the cylinder through the housing and thereby axially displace the cylinder relative to the frame member. Similarly, the adjustment mechanism is operable to axially move the housing in an opposite direction to exert a force upon the resilient members by which the cylinder is axially moved in a corresponding direction.

A gear member is rotatably secured to the shaft end portion and is axially movable relative thereto. A helical driven gear is coaxially mounted on the gear member and is axially and non-rotatably secured to the gear member. A helical drive gear is fixed relative to the helical driven gear and is positioned in meshing relation therewith. A circumferential adjustment housing is rotatably secured to the gear member for relative rotation between the gear member and the housing. The adjacent support frame non-rotatably supports the circumferential adjustment housing. The housing is axially movable relative to the adjacent support frame. Resilient members are retained within the housing and abut at one end portion the housing and at the other end portion are rigidly fixed relative to the adjacent support frame so that the resilient members exert a force upon the circumferential adjustment housing to move it axially toward and away from the main frame. A circumferential adjustment mechanism is secured to the housing and is rotatably fixed to the adjacent support frame for axially moving the housing in a preselected direction. Thus, by axially moving the circumferential adjustment housing in a preselected direction through the resilient members, the gear member is axially displaced to axially move the helical driven gear relative to the helical drive gear. Axial movement of the driven gear relative to the drive gear rotates the driven gear to rotate the shaft end portion and thereby adjust the circumferential register of the cylinder.

Both the axial adjustment housing and the circumferential adjustment housing are provided with stop members that non-rotatably secure the housings to the adjacent support frame. In this manner, the housings are arranged to move axially relative to the main frame in the support frame. Furthermore, the housings are rotatably mounted to the shaft end portion to permit relative axial movement between each other. With this arrangement, it is possible to simultaneously and independently control the axial and circumferential register of the plate cylinder relative to the main frame as the plate cylinder rotates. The circumferential adjustment housing is mounted in a bearing assembly that is axially fixed to the gear member. Axial movement of the circumferential adjustment housing by the adjustment mechanism is transmitted through the bearing assembly to the gear member to provide axial displacement of the gear member on the shaft end portion.

The axial adjustment housing is mounted in a bearing assembly that is axially fixed to the shaft end portion to permit rotation of the shaft end portion relative to the axial adjustment housing. Accordingly, axial displacement of the housing through the adjustment mechanism is transmitted through the bearing assembly to the shaft end portion and therefrom to the plate cylinder for axial register adjustment thereof.

Accordingly, the principal object of the present invention is to provide apparatus for adjusting the position of a cylinder in a press frame that permits simultaneous and independent adjustments to the axial and circumferential register of the cylinder relative to the press frame.

Another object of the present invention is to provide apparatus for controlling the circumferential and axial register of a plate cylinder within a press frame by axially moving the shaft end portion of the cylinder relative to the press frame in a manner that does not require complex gear trains and linkage devices for adjusting the circumferential and axial register of the cylinder as the cylinder rotates.

A further object of the present invention is to provide register control apparatus for circumferential and axial register of a plate cylinder in a press frame that permits precise adjustments to the circumferential and axial register as the cylinder rotates.

An additional object of the present invention is to provide circumferential and axial register adjustment apparatus for a plate cylinder in a press frame that substantially rescues the wear upon the relatively moving parts.

These and other objects and advantages of this invention will be more completely disclosed and described in the following specification, accompanying drawings, and and appended claims.

DESCRIPTION OF THE PREFERRED EMBODIMENTS

Figure 1:
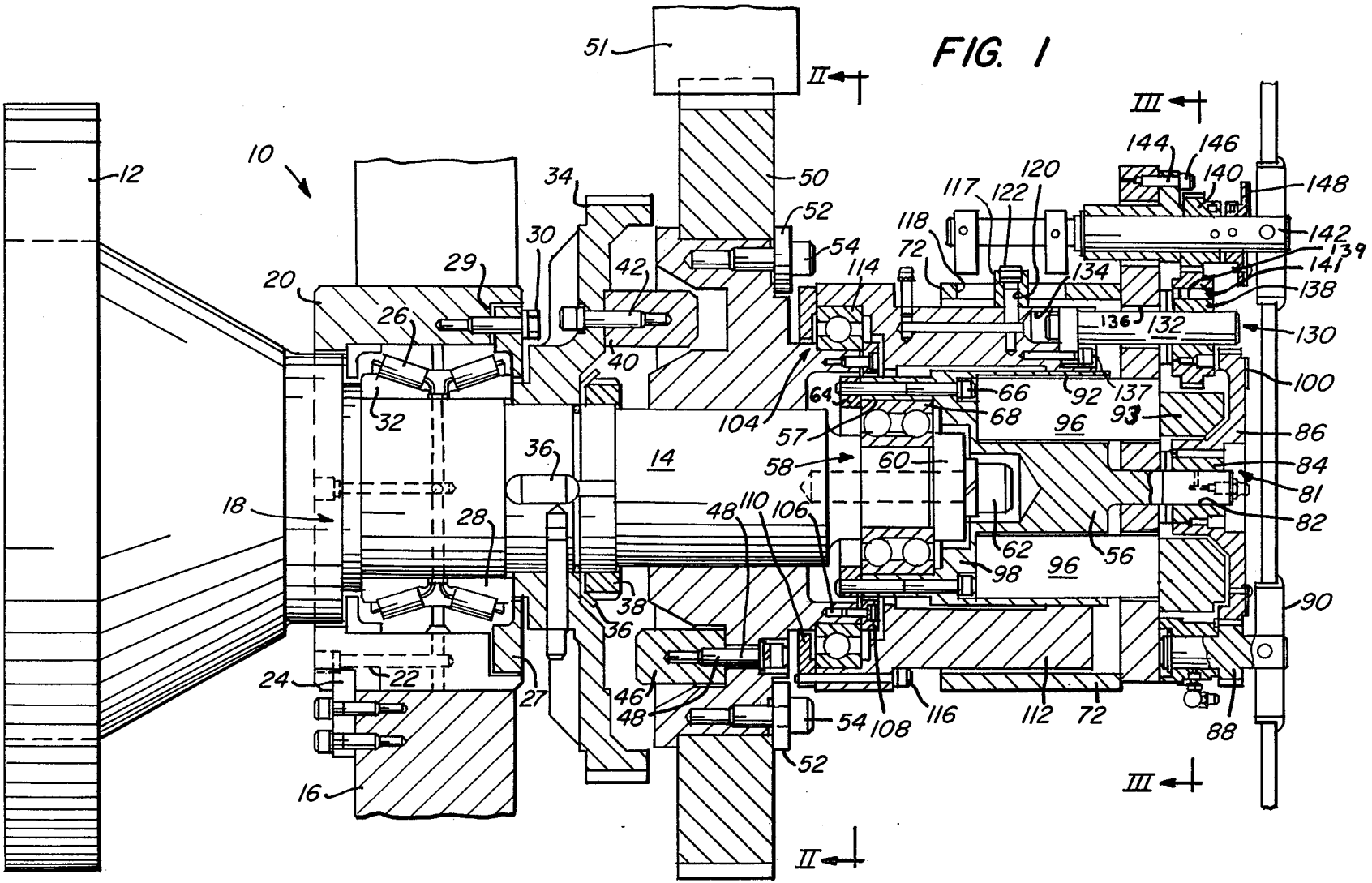
FIG. 1 is a sectional view in side elevation of the apparatus for adjusting the axial register and circumferential register of a plate cylinder in a press frame.
Figure 2:
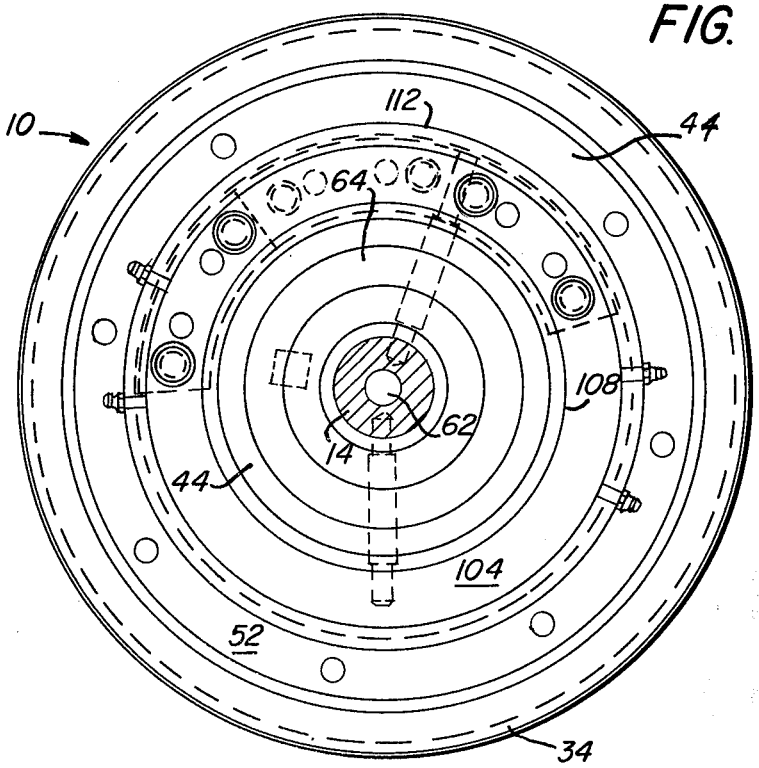
FIG. 2 is a side elevation partially in section, taken along the line 2—2 of FIG. 1 with the helical driven gear removed, illustrating the axial adjustment housing and the circumferential housing positioned on the plate cylinder shaft end portion for adjusting the axial and circumferential register of the plate cylinder.

Referring to the drawings and more particularly to FIG. 1, there is illustrated apparatus generally designated by the numeral 10 for adjusting the axial and circumferential register of a place cylinder that includes a plate cylinder 12 having a shaft end portion 14 rotatably supported in a press frame 16 by a bearing housing generally designated by the numeral 18. The bearing housing 18 has a sleeve member 20 with a longitudinal slot 22. A key 24 is pinned to the main frame 16 and extends into the slot 22. With this arrangement the sleeve member 20 is prevented from rotating in the frame 16 and the shaft end portion 14 is axially movable relative to the frame 16. A tapered roller bearing 26 rotatably supports the shaft end portion 14 within the sleeve 20. A ring member 27 is retained within a recessed annular portion 29 of sleeve 20 in abutting relation with outer race 28 of bearing 26. A bolt 30 connects the ring member 27 to the sleeve 20 to secure the sleeve 20 to the outer race 28. The inner race 32 is mounted on the shaft end portion 14 to permit the shaft end portion to freely rotate relative to the main frame 16. Thus the arrangement for relative axial movement of the shaft end portion 14 relative to the main frame 16 permits axial register of the plate cylinder 12 within the frame 16.

An inker drive gear 34 is non-rotatably positioned on the shaft end portion 14 and secured thereto by a key 35 and is axially fixed on the shaft 14 by washer bearing 36 and bearing nut 38. A drive block 40 is pinned to the gear 34 by bolt 42. A gear hub 44 is axially positioned on the shaft end portion 14, and a pair of drive blocks 46 (only one of which is shown in FIG. 1) are secured by bolts 48 to the gear hub 44 and are positioned oppositely of drive block 40. In this manner, the plate cylinder 12 is driven by the connection of the drive blocks 40 and 46 to the inker drive gear 34 and the gear hub 44.

A helical gear 50 is coaxially positioned on the gear hub 44 and is secured non-rotatably thereto by ring member 52 and bolts 54. The helical gear 50 is arranged in meshing relation with a helical drive gear 51. Axial movement of the gear 50 relative to the fixed helical gear 51 effects rotation of the helical gear 50, gear hub 44 and shaft end portion 14 to provide circumferential register adjustment of the plate cylinder 12.

An axial adjustment housing generally designated by the numeral 56 in FIG. 1 has a cylindrical recess portion 57. The shaft end portion 14 extends into the housing recess 57. A double roller bearing assembly 58 is positioned between the shaft 14 and recess 57 to rotatably secure the housing 56 to the shaft end portion 14. The bearing assembly 58 is secured to the end of the shaft 14 by a cap 60 and bolt 62. A ring member 64 is coaxially positioned on the shaft end portion 14 and rotatable relative to. The ring member 64 abuts the outer race of bearing assembly 58 and is fixed against axial movement on the shaft 14. The axial adjustment housing 56 is secured to the ring member 64 by bolts 66. With this arrangement, the housing 56 is secured to outer race 68 of the bearing assembly 58 so that the shaft 14 rotates relative to the housing 56 but is secured for axial movement therewith to adjust the axial register of the plate cylinder 12.

Figure 3:
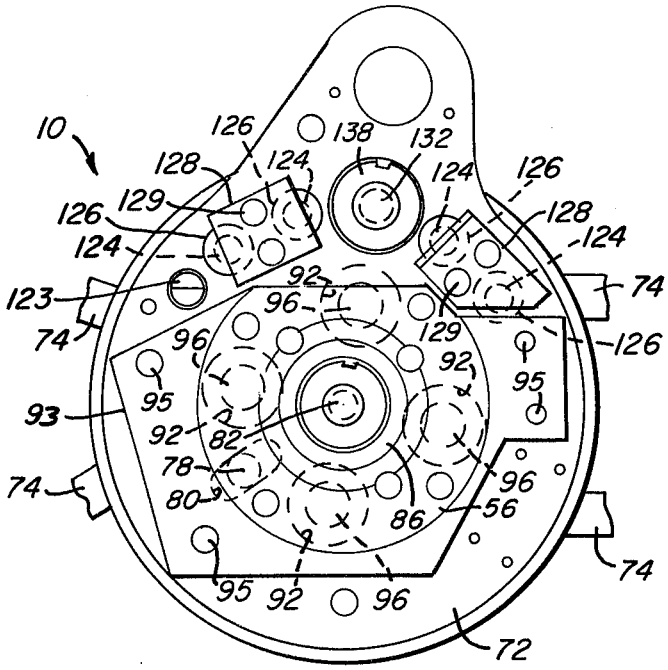
FIG. 3 is a view in side elevation taken along the line 3—3 of FIG. 1, illustrating the adjustment mechanisms and spring members for axially moving the axial adjustment housing and the circumferential adjustment housing for selected axial and rotational movement of the plate cylinder.
Figure 4:
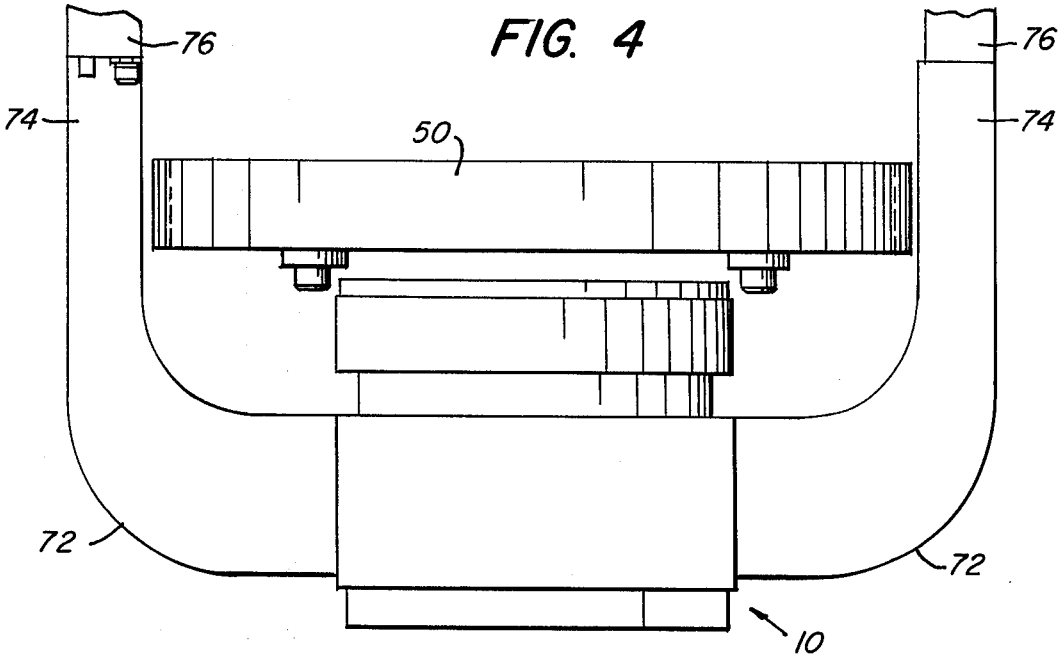
FIG. 4 is a fragmentary top plan view of the support frame for non-rotatably mounting the axial and circumferential adjustment mechanisms on the press frame.
Figure 5:
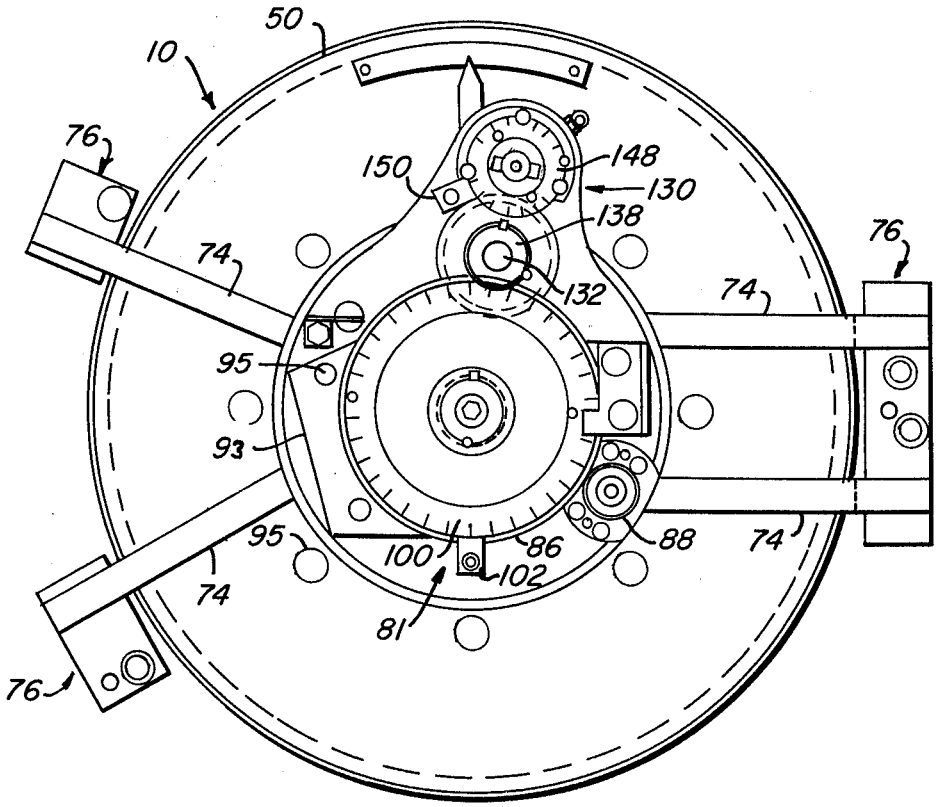
FIG. 5 is an end view of the axial and circumferential adjustment mechanisms, illustrating the support frame for mounting the axial and circumferential register adjustment mechanisms of the plate cylinder.

As illustrated in FIGS. 1, 3, 4 and 5, a support frame 72 having a plurality of outwardly extending brace members 74 is non-rotatably secured to the main frame 16 by fastener means generally designated by the numeral 76 and illustrated in FIGS. 4 and 5. The support frame 72 non-rotatably supports the axial adjustment housing 56 by an axial housing stop pin 78, as illustrated in FIG. 3. The stop pin 78 is positioned within an elliptical recess 80 of the support frame 72 and extends into an aligned hole (not shown) of the housing 56. With this arrangement, the housing 56 is non-rotatably secured to the support frame 72.

The axial adjustment housing 56 is supported in the support frame 72 by an axial adjustment mechanism generally designated by the numeral 81. The axial adjustment housing 56 has a threaded end portion 82 that extends through the support frame 72. A nut 84 is threadedly secured to the housing end portion 82, and a gear member 86 is coaxially positioned on nut 84 and is non-rotatably secured thereto. The gear member 86 is, in turn, non-rotatably secured to a gear member 88 that is rotatably supported by support frame 72 and a cover plate 90. With this arrangement, rotation of the gear member 86 in a preselected direction through gear member 88 rotates nut 84 to axially move the axial adjustment housing 56 toward and away from the main frame 16 within the support frame 72.

The axial adjustment housing 56 includes a plurality of longitudinal recesses 92, illustrated in FIGS. 1 and 3, that are positioned radially from the housing threaded end portion 82. The open end portions of the housing recesses 92 are sealed by a stop block 93 that is secured by bolts 95 to the support frame 72. Resilient members 96, such as compression springs, are positioned within each of the recesses 92 and are arranged to abut at one end portion shoulder 98 of the housing 56 and at the other end portion the stop block 93. With this arrangement, the spring members 96 are retained within the housing recesses 92 in a compressed state and exert an axial force upon the housing shoulder 98 to urge the axial adjustment housing 56 toward the main frame 16 upon selective rotation of gear member 88 to move the plate cylinder 12 away from the main frame 16. Accordingly, rotation of gear member 88 to move the plate cylinder 12 toward the main frame 16 compresses spring members 96 within recess 92 by the axial movement of housing 56 toward stop block 93. With the housing threaded end portion 82 secured to the nut 84 and the spring force exerted by resilient members 96 upon the housing 56, the housing 56 will be restrained from vibrating in frame 72 and consequently reduce the wear upon nut 84 and the other relatively moving parts of the axial adjustment mechanism 81.

In the illustrated embodiment of the present invention, clockwise rotation of the gear member 86 is transmitted through the nut 84 to the threaded end portion 82 of the housing 56 to advance the threaded end portion 82 axially out of the nut 84 so that the housing 56 moves away from the main frame 16. Axial movement of the housing 56 in this direction compresses the spring members 96 between the shoulder 98 and the stop block 93. Compression of the spring members 96 advances the housing 56 away from the main frame 16. Axial movement of the housing 56 away from the frame 16 urges the shaft end portion 14 to move axially relative to the main frame 16. Accordingly, axial movement of the shaft end portion 14 moves the plate cylinder 12 axially relative to the main frame 16 to adjust the axial register of cylinder 12.

Similarly, rotation of the gear member 86 in a counter-clockwise direction axially moves the housing 56 toward the main frame 16. Counter-clockwise rotation of a gear member 86 draws the housing threaded end portion 82 into support frame 72 to relieve the compressive force exerted by the housing 98 upon the end portions of the springs 96. Relieving the compressive forces exerted by the housing 56 upon the spring members 96 permit expansion of the spring members 96 within the recesses 92 to urge the housing 56 toward the main frame 16. The axial movement of the housing 56 is transmitted through the bearing assembly 58 to the shaft end portion 14. This advances the plate cylinder 12 away from the main frame 16. Thus with the above described arrangement the axial adjustment of the plate cylinder 12 relative to the main frame 16 is accomplished as the plate cylinder 12 rotates.

The axial position of the plate cylinder 12 relative to the main frame 16 may be indicated by a dial 100 that is secured to the periphery of gear member 86, as illustrated in FIGS. 1 and 5. The dial 100 is graduated in preselected increments. A pointer 102 is fixed in overlapping relation with the dial 100 for zeroing the axial position of the plate cylinder 12 within the main frame 16. By turning the gear member 88 meshing with the gear member 86 in a preselected direction, the axial register of the plate cylinder 12 may be adjusted with respect to zero position as indicated by the pointer 102 overlying the zero gradient on the dial 100.

To effect circumferential register adjustment of the plate cylinder 12 a single roller bearing assembly generally designated by the numeral 104 is secured by a pin member 106 to the gear hub 44. The pin member 106 extends through a ring member 108 surrounding bearing assembly 58 to secure the bearing assembly 104 to the gear hub 44. A circumferential adjustment housing 112 is positioned within support frame 72 and is rotatably secured to the bearing assembly 104 for axial movememnt relative to the axial adjustment housing 56. The housing 112 is secured to outer race 114 of bearing assembly 104 by a pin 116 that extends through housing 112 and a ring member 110 that abuts outer race 114 and is rotatably positioned on gear hub 44. With this arrangement the gear hub 44 is secured for axial movement with housing 112 on the shaft end portion 14 and is rotatable relative to the housing.

The circumferential adjustment housing 112 is non-rotatably secured to the support frame 72 by a circumferential housing stop lock 117, illustrated in FIG. 1, that extends through an elliptical opening 118 in the top of the support frame 72. The stop lock 117 abuts the housing 112 and includes a bore 120 extending therethrough. A pin member 122 extends through the bore 120 into the housing 112 to secure the stop lock 117 to housing 112 and prevent rotation of the housing 112 relative to the support frame 72.

Referring to FIG. 3, there is illustrated a plurality of resilient members 124, such as compression springs similar to the compression spring 96 above described, that are retained within longitudinal recesses 126 of the housing 112. Each of the compression springs 124 has one end portion abutting a shoulder (now shown) of the circumferential adjustment housing 112 and passing through an opening in the support frame 72. The other end of each of the compression springs 124 abuts the inner surface of spring compressing blocks 128. The blocks 128 are secured to the outer surface of support frame 72 by pins 129 as illustrated in FIG. 3. With this arrangement one end portion of each of the springs 126 abuts the stationary blocks 128 and consequently the other end portion abuts the shoulder of the housing 112 to exert a compressive force upon the circumferential adjustment housing 112 to urge the housing 112 toward the main frame 16.

A circumferential adjustment mechanism generally designated by the numeral 130 for effecting circumferential register adjustment of the plate cylinder 12 through axial movement of the housing 112 and gear hub 44 relative to the shaft end portion 14 includes a threaded member 132 that extends into a bore 134 of the housing 112. The threaded member 132 extends through an opening 136 in the support frame 72 and is non-rotatably secured to the housing 112 by pin member 137. The threaded end portion of member 132 is rotatably connected to a nut 138 that is coaxially positioned on the member 132. The nut 138 is, in turn, non-rotatably connected by a key 139 to a gear member 141 that meshes with a gear 140. The gear 140 is non-rotatably pinned to a shaft 142. The shaft 142 is rotatably positioned in a sleeve member 144 that is non-rotatably secured by a pin member 146 to the support frame 72.

As illustrated in FIGS. 1 and 5, a dial 148 is also pinned to shaft 142 adjacent gear 140. The dial 148 includes graduated increments and is arranged in overlying relation with a pointer 150 that is fixed to the support frame 72 as illustrated in FIG. 5. With this arrangement, rotation of the dial 148 in a preselected direction and through a preselected angle rotates the shaft 142 and gear 140 to rotate gear 141 and nut 138 in a preselected direction. Rotation of nut 138 in a preselected direction axially moves the threaded member 132 through the opening 136 in the support frame 72 to provide axial movement of the circumferential adjustment housing 112 toward and away from the main frame 16. Axial movement of the housing 112 relative to the housing 56 is transmitted through the bearing assembly 104 to, in turn, axially displace the gear hub 44 and the helical driven gear 50 relative to helical drive gear 51 on the shaft end portion 14. With gear 51 fixed relative to gear 50 and meshing therewith axial movement of the gear 50 relative to the gear 51 rotates the helical gear 50 and gear hub 44 to rotate the shaft end portion 14 through a preselected angle of rotation. Accordingly, the plate cylinder 12 is rotated in a preselected direction through a preselected angle to adjust the circumferential register of the plate cylinder 12 in the main frame 16.

In the illustrated embodiment of the present invention clockwise rotation of the dial 148 is transmitted through the shaft 142 to the gear 140 to rotate the gear 141 and nut 138 in a counter-clockwise direction and axially advance the shaft 132 and the circumferential adjustment housing 112 relative to the housing 56 toward the main frame 16. Axial advancement of the housing 112 axially moves the compression springs 124 retained within the recesses 126 of the housing 112 and further urges the housing toward the main frame 16. Axial movement of the housing 112 in this direction displaces the gear hub 44 on the shaft end portion 14 so that corresponding axial displacement of helical gear 50 effects rotation of the helical gear 50 meshing with drive hear 51 to rotate the shaft 14 and the plate cylinder 12 through a preselected angular displacement to provide the desired adjustment to the circumferential register of the cylinder 12.

Rotation of the dial 148 in a counter-clockwise direction rotates the gear 141 and nut 138 in a clockwise direction to urge the shaft 132 and the housing 112 to move axially relative to the housing 56 away from the main frame 16. Movement of the housing 112 axially displaces the gear hub 44 and the helical gear 50. Axial displacement of the helical gear 50 meshing with fixed gear 51 effects rotation of the gear 50 relative to drive gear 51 to rotate the shaft 14 and the plate cylinder 12 in a direction opposite to that previously described so as to further adjust the circumferential register of the plate cylinder 12 within the main frame 16.

With the above described arrangement for the circumferential register adjustment, rotation of dial 148 through a single revolution in a preselected direction preferably provides for a circumferential register adjustment for the cylinder 12 of 0.020 in. as indicated by the dial 148. Therefore, five revolutions of the dial 148 in a selected direction circumferentially moves the cylinder 12 0.100 in. in a corresponding direction. To indicate the number of revolutions through which the plate cylinder has rotated in a given direction from its initial center position a pin member 123 having a dial (not shown) attached thereto extends through the frame 72 and is secured to the housing 112. Therefore, the number of revolutions of the cylinder 12 from its center position relative to the frame 12 is indicated by the position of the dial on pin member 123. Thus, the operator is informed at all times as to the circumferential register of the cylinder 12 relative to its center position in the main frame 16.

Thus it will be apparent from the above described invention that the axial register of the plate cylinder 12 in the main frame 16 may be adjusted by the axial movement of the shaft end portion 14 through the axial adjustment housing 56 and the axial adjustment mechanism 81. Not only may the axial register be adjusted by simultaneously therewith or independently thereof, the plate cylinder 12 may be rotated through a preselected angle to adjust the circumferential register of the clinder 12 in the press frame 16. By supporting the circumferential adjustment housing 112 in the support frame 72 for axial movement relative to the axial adjustment housing 56, the circumferential and axial register adjustments may be made without interference between the axially moving housings 56 and 112.

According to the provisions of the Patent Statutes, I have explained the principle, preferred construction and mode of operation of my invention and have illustrated and described what I now consider to represent its best embodiment. However, it should be understood that, within the scope of the appended claims, the invention may be practiced otherwise than is specifically illustrated and described.

I claim:

1. Apparatus for adjusting the position of a cylinder in a press frame comprising, a cylinder having a shaft end portion, frame means for rotatably supporting said shaft end portion, said cylinder mounted for axial movement relative to said frame means, a housing rotatably secured to said shaft end portion for axial movement relative to said frame means, said housing having a threaded end portion, adjacent supporting means extending outwardly from said frame means for non-rotatably supporting said housing, said adjacent supporting means non-rotatably fixed to said frame means, said housing axially movable relative to said adjacent supporting means, resilient means for axially moving said housing in a preselected direction relative to said adjacent supporting means, said resilient means positioned within said housing and having one end portion fixed to said adjacent supporting means and the other end portion abutting said housing, and adjustment means secured to said housing threaded end portion and rotatably fixed to said adjacent supporting means for axially moving said housing in a preselected direction relative to said frame means, said adjustment means operable to axially move said housing in one direction and thereby axially move said cylinder in a corresponding direction and to axially move said housing in an opposite direction and thereby move said cylinder in a corresponding direction.

2. Apparatus for adjusting the position of a cylinder in a press frame as set forth in claim 1 which includes, means for rotatably securing said housing to said shaft end portion.

3. Apparatus for adjusting the postion of a cylinder in a press frame as set forth in claim 2 which includes, a bearing assembly coaxially positioned on and axially secured to said shaft end portion, said housing having a cylindrical recess portion, said bearing assembly positioned within said cylindrical recess portion and axially fixed to said housing to permit rotation of said shaft end portion relative to said housing, and means for moving said shaft end portion axially relative to said frame means upon axial movement of said housing and said bearing assembly to thereby adjust the axial register of said cylinder.

4. Apparatus for adjusting the position of a cylinder in a press frame as set forth in claim 1 which includes, a plurality of longitudinal recesses positioned radially in said housing, said resilient means positioned in said recesses with one end portion abutting said housing and the other end portion extending from said recesses and axially fixed in abutting relation with said adjacent supporting means, and said housing axially movable relative to said adjacent supporting means against the force of said resilient means upon rotation of said adjustment means to axially move said cylinder relative to said frame means.

5. Apparatus for adjusting the position of a cylinder in a press frame as set forth in claim 1 which includes, means for non-rotatably securing said housing to said adjacent supporting means.

6. Apparatus for adjusting the position of a cylinder in a press frame as set forth in claim 5 which includes, said adjacent supporting means surrounding said housing and having an elliptical recess overlying said housing, and pin means extending through said elliptical recess into said housing for non-rotatably engaging said housing to said adjacent supporting means.

7. Apparatus for adjusting the position of a cylinder in a press frame as set forth in claim 1 which includes, said adjacent supporting means having a plurality of brace members secured to and extending outwardly from said frame means non-rotatably secure said adjacent supporting means to said frame means.

8. Apparatus for adjusting the position of a cylinder in a press frame as set forth in claim 1 which includes, said adjustment means including a nut threadedly secured to said housing threaded end portion, gear means non-rotatably secured to said nut for rotating said nut in a preselected direction to axially move said housing in said adjacent supporting means toward and away from said frame means to adjust the axial register of said cylinder, and said gear means rotatably secured to said adjacent supporting means for indicating the axial register of said cylinder in said frame means.

9. Apparatus for adjusting the position of a cylinder in a press frame as set forth in claim 1, which includes, a stop block positioned in abutting relation with one end portion of said resilient means so that said resilient means exerts an axial force upon said housing to maintain said adjustment means immovable relative to said housing with said cylinder in a preselected axial position.

10. Apparatus for adjusting the position of a cylinder in a press frame comprising, a cylinder having a shaft end portion, frame means for rotatably supporting said shaft end portion, said cylinder mounted for axial movement relative to said frame means, gear means rotatably secured to said shaft end portion, said gear means axially movable relative to said shaft end portion, a helical driven gear non-rotatably secured to said gear means, said helical driven gear coaxially positioned on said gear means, a helical drive gear fixed relative to said helical driven gear and positioned in meshing relation therewith, a housing rotatably secured to said gear means for axial movement relative to said frame means, adjacent supporting means extending outwardly from said frame means for non-rotatably supporting said housing, said adjacent supporting means non-rotatably fixed to said frame means, said housing axially movable relative to said adjacent supporting means, resilient means for axially moving said housing in a preselected direction relative to said adjacent supporting means, said resilient means positioned within said housing and having one end portion fixed to said adjacent supporting means and the other end portion abutting said housing, adjustment means secured to said housing and rotatably fixed to said adjacent supporting means for axially moving said housing in a preselected direction, and said adjustment means operable to axially move said housing in a preselected direction to axially move said housing and said helical driven gear to rotate said helical driven gear relative to said helical drive gear and adjust the circumferential register of said cylinder.

11. Apparatus for adjusting the position of a cylinder in a press frame as set forth in claim 10 which includes, means for rotatably securing said housing to said gear means, and said housing coaxially positioned on and axially fixed to said shaft end portion.

12. Apparatus for adjusting the position of a cylinder in a press frame as set forth in claim 10 which includes, means or rotatably securing said housing to said gear means having a bearing assembly coaxially positioned on and axially secured to said gear means, said bearing assembly axially fixed to said housing to permit rotation of said gear means relative to said housing, and means for axially moving said gear means on said shaft end portion upon axial movement of said housing and said bearing assembly to rotate said helical driven gear relative to said helical drive gear and thereby adjust the circumferential register of said cylinder.

13. Apparatus for adjusting the position of a cylinder in a press frame as set forth in claim 10 which includes, a plurality of longitudinal recesses positioned in said housing, said resilient means positioned in said recesses with one end portion abutting said housing and the other end portion extending from said recesses and axially fixed in abutting relation with said adjacent supporting means, and said housing being axially movable in one direction relative to said adjacent supporting means by the force of said resilient means and axially movable in the opposite direction against the force of said resilient means upon rotation of said adjustment means to rotate said cylinder in a preselected direction relative to said frame means.

14. Apparatus for adjusting the position of a cylinder in a press frame as set forth in claim 10 which includes, said adjustment means having threaded means non-rotatably secured to said housing for moving said housing axially in said adjacent support means, a nut threadedly secured to said threaded means, gear means non-rotatably secured to said nut for rotating said nut in a preselected direction to axially move said threaded means and said housing to adjust the circumferential register of said cylinder in said frame means, and said gear means rotatably secured to said adjacent supporting means for indicating the circumferential register of said cylinder in said frame means.

15. Apparatus for adjusting the position of a cylinder in a press frame as set forth in claim 10 which includes, means for non-rotatably securing said housing to said adjacent supporting means.

16. Apparatus for adjusting the position of a cylinder in a press frame as set forth in claim 15 which includes, said adjacent supporting means surrounding said housing and having an elliptical opening overlying said housing, a stop lock extending through said elliptical opening into abutting relation with said housing, and pin means for engaging said stop lock to said housing to prevent rotation of housing within said adjacent supporting means.

17. Apparatus for adjusting the position of a cylinder in a press frame as set forth in claim 10 which includes, resilient compressing means for securing said resilient means with said housing, said resilient compressing means fixed to said adjacent supporting means and abutting one end portion of said resilient means so that said resilient means maintain an axial force upon said housing.

18. Apparatus for adjusting the position of a cylinder in a press frame as set forth in claim 10 in which said gear means includes, a gear hub rotatably secured to said shaft end portion and coaxially movable relative thereto, said gear hub axially fixed to said bearing assembly and non-rotatably secured to said helical driven gear, and said gear hub axially movable with said housing upon rotation of said adjustment means to axially displace said driven helical gear relative to said drive helical gear and rotate said driven helical gear and said gear hub to adjust the circumferential register of said cylinder.

19. Apparatus for adjusting the position of a cylinder in a press frame comprising, a cylinder having a shaft end portion, frame means for rotatably supporting said shaft end portion, said cylinder mounted for axial movement on said frame means, a support frame extending outwardly from said frame means, said support frame non-rotatably fixed to said frame means, an axial adjustment housing non-rotatably secured to said shaft end portion for axial movement relative to said frame means, said axial adjustment housing non-rotatably secured to said support frame, a circumferential adjustment housing non-rotatably secured to said support frame for axial movement relative to said axial adjustment housing, gear means secured to said circumferential adjustment housing and supported on said shaft end portion for axial movement with said circumferential adjustment housing, a helical driven gear non-rotatably secured to and coaxially positioned on said gear means, a helical drive gear fixed relative to said helical driven gear and positioned in meshing relation therewith so that axial movement of said helical driven gear relative to said helical drive gear rotates said helical driven gear and said gear means to adjust the circumferential register of said cylinder, adjustment means rotatably supported by said support frame and secured to said axial adjustment housing and said circumferential adjustment housing for independently, selectively moving said respective housings axially relative to said support frame to adjust the axial and circumferential register of said cylinder in said frame means, and drive means connected to said gear means for transmitting rotatation to said shaft end portion for rotating said cylinder.

* * * * *